US009745113B2

(12) United States Patent
Yoshifusa

(10) Patent No.: US 9,745,113 B2
(45) Date of Patent: Aug. 29, 2017

(54) STRUCTURE OF INFLATABLE CORNER PACKING DEVICE

(71) Applicants: AIR-PAQ, INC., Las Vegas, NV (US); PERFORMANCE PACKAGING, INC., Harvey, LA (US); Kark K. Yoshifusa, Lake Forest, CA (US)

(72) Inventor: Kark K. Yoshifusa, Lake Forest, CA (US)

(73) Assignees: AIR-PAQ, INC., Las Vegas, NV (US); PERFORMANCE PACKAGING, INC., Harvey, LA (US); Kark K. Yoshifusa, Lake Forest, CA (US)

( * ) Notice: Subject to any disclaimer, the term of this patent is extended or adjusted under 35 U.S.C. 154(b) by 162 days.

(21) Appl. No.: 14/715,482

(22) Filed: May 18, 2015

(65) Prior Publication Data

US 2016/0340103 A1 Nov. 24, 2016

(51) Int. Cl.
*B65D 81/05* (2006.01)

(52) U.S. Cl.
CPC ..... *B65D 81/054* (2013.01); *B65D 81/052* (2013.01); *B65D 81/057* (2013.01); *B65D 2581/055* (2013.01)

(58) Field of Classification Search
CPC ..... B65D 81/02; B65D 81/05; B65D 81/052; B65D 81/053; B65D 81/054; B65D 2581/055; B65D 81/57
USPC ..... 206/453, 522, 586; 383/3
See application file for complete search history.

(56) References Cited

U.S. PATENT DOCUMENTS

| | | | | |
|---|---|---|---|---|
| 6,276,532 | B1 * | 8/2001 | Sperry | B65D 81/052 206/522 |
| 6,520,332 | B1 * | 2/2003 | Barmore | B65D 81/052 206/522 |
| 6,722,502 | B1 * | 4/2004 | Newman | B65D 81/052 206/453 |
| 7,000,767 | B2 | 2/2006 | Tanaka et al. | |
| 7,165,677 | B2 | 1/2007 | Tanaka et al. | |
| 7,204,278 | B2 | 4/2007 | Koyanagi et al. | |
| 7,410,057 | B2 * | 8/2008 | Yoshifusa | B65D 81/075 206/522 |
| 7,422,108 | B2 * | 9/2008 | Yoshifusa | B65D 81/052 206/522 |
| 7,422,109 | B2 * | 9/2008 | Yoshifusa | B65D 81/052 206/522 |

(Continued)

*Primary Examiner* — Bryon Gehman
(74) *Attorney, Agent, or Firm* — Law Office of Katsuhiro Arai

(57) ABSTRACT

An inflatable corner packing device for protecting corners of a product includes: first and second thermoplastic films having a first section, a second section, and an elbow section connecting the first and second sections in a vertical direction, wherein a plurality of fluid containers each extending in the vertical direction, and the first and second sections and the elbow section each have a right side portion, a left side portion, and a middle portion connecting the right and left side portions, wherein the side portions are inwardly crooked for holding a product therebetween. The first and second thermoplastic films are folded, and the folded films are bonded in the elbow section along a border between adjacent fluid containers in each crooked side portion, leaving a remaining portion of the border unbonded, so that the bonded borders form the elbow section.

12 Claims, 13 Drawing Sheets

(56) References Cited

U.S. PATENT DOCUMENTS

| | | | | |
|---|---|---|---|---|
| 7,445,117 | B2 | 11/2008 | Kojima et al. | |
| 7,481,252 | B2 | 1/2009 | Koyanagi | |
| 7,482,051 | B2 | 1/2009 | Tanaka et al. | |
| 7,631,762 | B2 * | 12/2009 | Liao | B65D 81/052 206/522 |
| 7,694,701 | B2 | 4/2010 | Koyanagi | |
| 7,938,264 | B2 * | 5/2011 | Yoshifusa | B65D 81/052 206/522 |
| 8,277,910 | B2 | 10/2012 | Koyanagi et al. | |
| 9,027,756 | B2 * | 5/2015 | Yoshifusa | B65D 81/052 206/522 |
| 2005/0006271 | A1 * | 1/2005 | Nakagawa | B65D 81/052 206/521 |
| 2008/0107362 | A1 * | 5/2008 | Yoshifusa | B65D 81/075 383/3 |

* cited by examiner

STRUCTURE OF INFLATABLE CORNER PACKING DEVICE

BACKGROUND OF THE INVENTION

Field of the Invention

The present invention generally relates to a structure of an inflatable corner packing device such as an air-packing device for use as a shock-absorbing packing material for securely protecting a corner of a product from shock or impact.

Description of the Related Art

In product distribution channels such as product shipping, a styrofoam packing material has been used for a long time for packing commodity and industrial products. Although the styrofoam package material has a good thermal insulation performance and a light weight, it has also various disadvantages. For example, recycling the styrofoam is not easy, soot is produced when it burns, a flake or chip comes off when it is snagged because of its brittleness, an expensive mold is needed for its production, and a relatively large warehouse is necessary to store it.

Therefore, to solve such problems noted above, other packing materials and methods have been proposed. One method is a fluid container containing a liquid or gas such as air (hereafter also referred to as an "air-packing device"). The air-packing device has excellent characteristics to solve the problems with styrofoam. First, because the air-packing device is made of only thin sheets of plastic films, it does not need a large warehouse to store it unless the air-packing device is inflated. Second, a mold is not necessary for its production because of its simple structure. Third, the air-packing device does not produce a chip or dust which may have adverse effects on precision products. Also, recyclable materials can be used for the films forming the air-packing device. Further, the air-packing device can be produced with low cost and transported and stored with low cost.

FIG. 1 shows an example of structure of conventional air-packing device, which is disclosed in U.S. Pat. No. 7,481,252 and U.S. Pat. No. 8,277,910. The air-packing device 20 includes a plurality of air containers 22 and check valves 24, a guide passage 21, and an air input 25. The air from the air input 25 is supplied to the air containers 22 through the air passage 21 and the check valves 24. Typically, the air-packing device 20 is composed of two thermoplastic films which are bonded together at bonding areas 23*a*.

Each air container 22 is provided a the check valve 24. One of the purposes of having multiple air containers with corresponding check valves is to increase the reliability, because each air container is independent from the others. Namely, even if one of the air containers suffers from an air leakage for some reason, the air-packing device can still function as a shock absorber for packing the product because other air containers are still inflated due to the corresponding check valves.

FIG. 2 (which is also disclosed in U.S. Pat. No. 7,481,252 and U.S. Pat. No. 8,277,910) is a plan view of the air-packing device 20 of FIG. 1 when it is not inflated which shows bonding areas for closing two thermoplastic films. The thermoplastic films of the air-packing device 20 are bonded (heat-sealed) together at bonding areas 23*a* which are at the rectangular periphery thereof to air tightly close the air-packing device 20. The thermoplastic films of the air-packing device 20 are also bonded together at bonding areas 23*b* which are boundaries of the air containers 22 to air-tightly separate the air containers 22 from one another.

When using the air-packing device, each air container 22 is filled with the air from the air input 25 through the guide passage 21 and the check valve 24. After filling the air, the expansion of each air container 22 is maintained because each check-valve 24 prevents the reverse flow of the air. The check valve 24 is typically made of two small thermoplastic films which are bonded together to form an air pipe. The air pipe has a tip opening and a valve body to allow the air flowing in the forward direction through the air pipe from the tip opening but the valve body prevents the air flow in the backward direction.

Air-packing devices are becoming more and more popular because of the advantages noted above. There is an increasing need to store and carry precision products or articles which are sensitive to shocks and impacts often involved in shipment of the products. There are many other types of product, such as TV monitors, computer displays, wine bottles, DVD drivers, music instruments, glass or ceramic wares, antiques, etc. that need special care so as to avoid shocks, vibrations or other mechanical impact. Thus, it is desired that the air-packing device protect the product to minimize any shock or impact. In case the product to be protected has relatively large corners such as those of a rectangular parallelepiped, it may be more economical to protect the corners separately, using multiple air-packing devices, instead of protecting the product or its multiple corners entirely. In order to effectively protect each corner, four sides, e.g., a front side, a back side, a top (or bottom) side, and right (or left) side near the corner edge, and edges where the sides meet each other need to be protected. However, it is difficult to produce a corner air-packing device having more than two sides perpendicular to each other, using a single inflatable sheet constituted by two thermoplastic films bonded together at bonding areas. Further, even if a corner air-packing device is produced using multiple inflatable sheets, the possibility exists that the air-packing device may be misaligned or out of position while packaging the product before securing the air-packing device by, e.g., placing the product into a container box, since the air-packing device is merely in contact with the corner(s) without an adhesive.

In the above, any discussion of problems and solutions in relation to the related art has been included in this disclosure solely for the purposes of providing a context for the present invention, and should not be taken as an admission that any or all of the discussion was known at the time the invention was made.

SUMMARY OF THE INVENTION

Some embodiments provide an inflatable corner packing device for effectively and securely protecting corners of a product. In some embodiments, the inflatable corner packing device comprises: (i) first and second thermoplastic films superposed with each other and extending between a first end and a second end and having a first section close to the first end, a second section close to the second end, and an elbow section connecting the first section and the second section, said first section extending from the elbow section along a first direction, said second section extending from the elbow section along a second direction roughly perpendicular to the first direction, wherein predetermined portions of the first and second thermoplastic films in the first, elbow, and second sections are bonded creating a plurality of fluid containers each extending between the first and second ends; (ii) a plurality of check valves connected to the plurality of fluid containers, respectively; and (iii) a fluid passage extending perpendicular to the first and second directions and connected to the check valves, wherein (iv) the first and second sections and the elbow section each have a right side portion, a left side portion, and a middle portion connecting the right and left side portions along a lateral direction perpendicular to the first and second directions, said side portions being inwardly crooked for holding a product therebetween, (v) the first and second thermoplastic films are folded, wherein the folded portion constitutes the elbow section, and the folded films are bonded in the elbow section along a border between adjacent fluid containers in each side portion, leaving a remaining portion of the border unbonded, and (vi) at least the fluid containers of the right and left side portions are inflated, wherein the bonded borders are positioned to form the right and left side portions of the elbow section, respectively, wherein the right and left side portions each have an inner side facing a product to be held and an outer side opposite to the inner side, and the bonded borders are disposed in the right and left side portions of the elbow section on their inner sides.

In some embodiments, the bonded borders are disposed in the right and left side portions of the elbow section on their inner sides by reversing a convex shape formed by the first section, the elbow section, and the second section when the fluid containers are inflated due to the bonded border, to a concave shape by pushing the bonded borders forward and outward to form the respective corners of the elbow section.

In some embodiments, the inflatable corner packaging device further comprises a plurality of heat-seal lands each bonding the first and second thermoplastic films in an area of each fluid container to create a plurality of series-connected cells in each fluid container, wherein the heat-seal lands are positioned in each fluid container in a manner to allow a fluid or gas to flow between the cells.

In some embodiments, the heat-seal lands are aligned along a first border between the first section and the elbow section, a second border between the second section and the elbow section, and a central edge between the first and second borders. In some embodiments, a width of each fluid container in each crooked side portion is substantially the same as or slightly smaller than a length between the first border and the central edge, and a length between the second border and the central edge when inflated.

In some embodiments, the middle portion comprises at least one of the plurality of fluid containers. In some embodiments, each fluid container contains a gas or fluid. In some embodiments, the middle portion of each first and second sections has a substantially rectangular shape when inflated.

In some embodiments, the fluid passage extends between the crooked side portions, and has a stopper at the second end. In some embodiments, the stopper is formed by bonding a portion of the first and second thermoplastic films in the fluid passage.

Other embodiments of the present invention provide a sheet comprising: (i) first and second thermoplastic films superposed with each other and extending between a first end and a second end and having a first section close to the first end, a second section close to the second end, and a connecting section connecting the first section and the second section, said first and second sections extending from the connecting section along a first direction, wherein predetermined portions of the first and second thermoplastic films in the first, connecting, and second sections are bonded creating a plurality of fluid containers each extending between the first and second ends; (ii) a plurality of check valves connected to the plurality of fluid containers, respectively; and (iii) a fluid passage extending perpendicular to the first direction and connected to the check valves, wherein (iv) the first and second sections and the elbow section have a right side portion, a left side portion, and a middle portion connecting the right and left side portions, and (v) the first and second thermoplastic films are folded, wherein the folded films are bonded in the connecting section along a border between adjacent fluid containers in the right side portion, leaving a remaining portion of the border unbonded, and along a border between adjacent fluid containers in the left side portion, leaving a remaining portion of the border unbonded.

Still other embodiments provide a zonal sheet comprising multiple sheets each as defined above and described elsewhere herein, wherein the multiple sheets are connected in a direction perpendicular to the first direction, wherein borders between adjacent sheets are perforated so that the multiple sheets are separable along the borders.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DETAILED DESCRIPTION OF EMBODIMENTS

Figure 1:
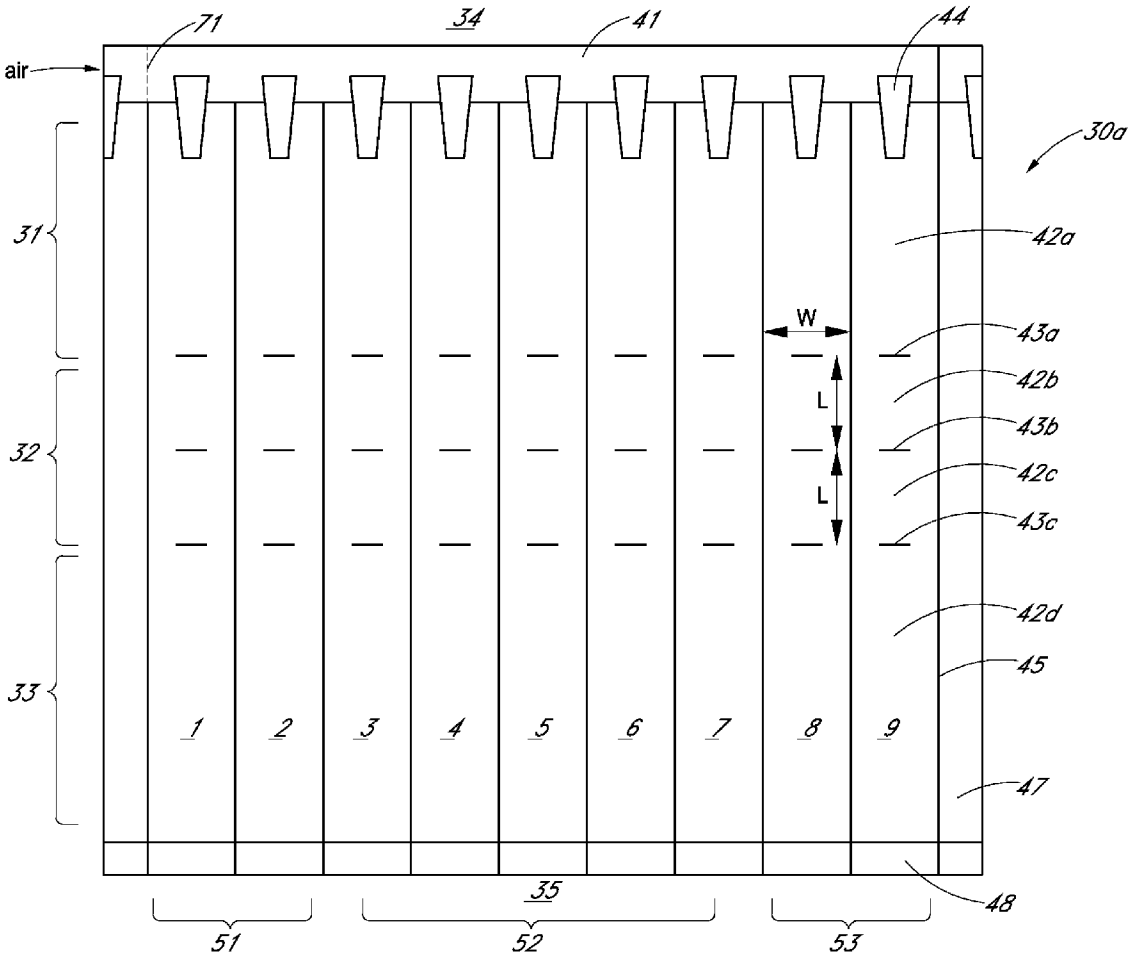
FIG. 1 is a plan view of an initial sheet of an inflatable corner packing device according to an embodiment of the present invention.

In the present disclosure where conditions and/or structures are not specified, a skilled artisan in the art can readily provide such conditions and/or structures, as a matter of routine experimentation, in view of the present disclosure and the disclosure of background art. For example, designing, making, and using multiple inflatable fluid containers which are comprised of inflatable cells divided by heat-seal lands and which are equipped with check valves are disclosed in U.S. Pat. No. 8,277,910, U.S. Pat. No. 7,165,677, U.S. Pat. No. 7,482,051, U.S. Pat. No. 7,204,278, U.S. Pat. No. 7,481,252, U.S. Pat. No. 7,694,701, U.S. Pat. No. 7,445,117, and U.S. Pat. No. 7,000,767, each disclosure of which is incorporated by reference in its entirety for some embodiments of the present invention. In this disclosure, the terms "constituted by" and "having" refer independently to "typically or broadly comprising", "comprising", "consisting essentially of", or "consisting of", depending on the embodiment, and an article "a" or "an" refers to a species or a genus including multiple species or a single piece, depending on the embodiment. Further, in this disclosure, the directions such as right, left, top, bottom, front, back, convex, and concave are used with reference to the drawings, but the directions are relative and changed as viewed from different directions. Additionally, any values of variables indicated (regardless of whether they are indicated with "about" or not) may refer to precise values or approximate values and include equivalents, and may refer to average, median, representative, majority, etc. in some embodiments. In all of the disclosed embodiments, any element used in an embodiment can be replaced with any elements equivalent thereto, including those explicitly, necessarily, or inherently disclosed herein, for the intended purposes. Further, the present invention can equally be applied to apparatuses and methods. In this disclosure, any defined meanings do not necessarily exclude ordinary and customary meanings in some embodiments.

The packing device according to various embodiments of the present invention will be described in more detail with reference to the accompanying drawings. It should be noted that although various embodiments are described for the case of using an air for inflating the packing device for an illustration purpose, other fluids such as other types of gas or liquid can also be used. The packing device is typically used in a container box to pack a product during the distribution of the product.

The packing device according to an embodiment of the present invention is especially useful for packing products which are sensitive to shock or vibration such as hard disk drives, personal computers, DVD drivers, TV monitors, computer displays, bottles, glassware, ceramic ware, musical instruments, paintings, antiques, etc., which have relatively large corners such as those of a rectangular parallelepiped where it is more economical to protect the corners separately, using multiple packing devices, instead of protecting the product or its multiple corners entirely. The packing device reliably holds corners of the product within a lining area of the packing device to secure the product to be protected. As a lining in the lining area prevents the product from directly touching an air container cushioning the product, rupture of the air container in turn is prevented also. The product and the packing device are then placed in a container box. Thus, the packing device absorbs the shocks and impacts applied to the product when, for example, the product is inadvertently dropped on the floor or collides with other objects.

The packing device of the present embodiments includes a plurality of air containers each having a plurality of serially connected cells. The air container is air-tightly separated from the other air containers while the cells in the same air container are connected by the air passages such that the air can flow among the cells through the air passages. Adjacent cells are separated by, e.g., a heat-seal land, so that the air container can easily be bent at the heat-seal land, enabling easy shaping of the container in various shapes. Thus, although the packing device can be formed without cells, it is preferable to use cells for easy, precise, and secure shaping. Each cell in the air container has a sausage-like shape when air fills in the air containers. The air containers are formed in four sides corresponding to, e.g., a front side, a back side, a top (or bottom) side, and right (or left) side near a corner of a product to be protected to ensure attachment of the packing device to the corner for protection to the product.

One embodiment of the present invention is described with reference to FIGS. 1 to 11. FIG. 7 is a perspective view showing each of four packing devices 30 holding each corner of a product 111 to be protected (TV monitor) for shock absorption. Normally, the TV monitor 111 and the packing devices 30 are placed in a container box, such as a corrugated carton, for transportation. Although there are many different types of TV monitors with different shapes and sizes, since the size and shape of the packing devices 30 of the present embodiment can easily be modified as described below, it is possible to accommodate all of the types of TV monitors or other products.

Figure 6:
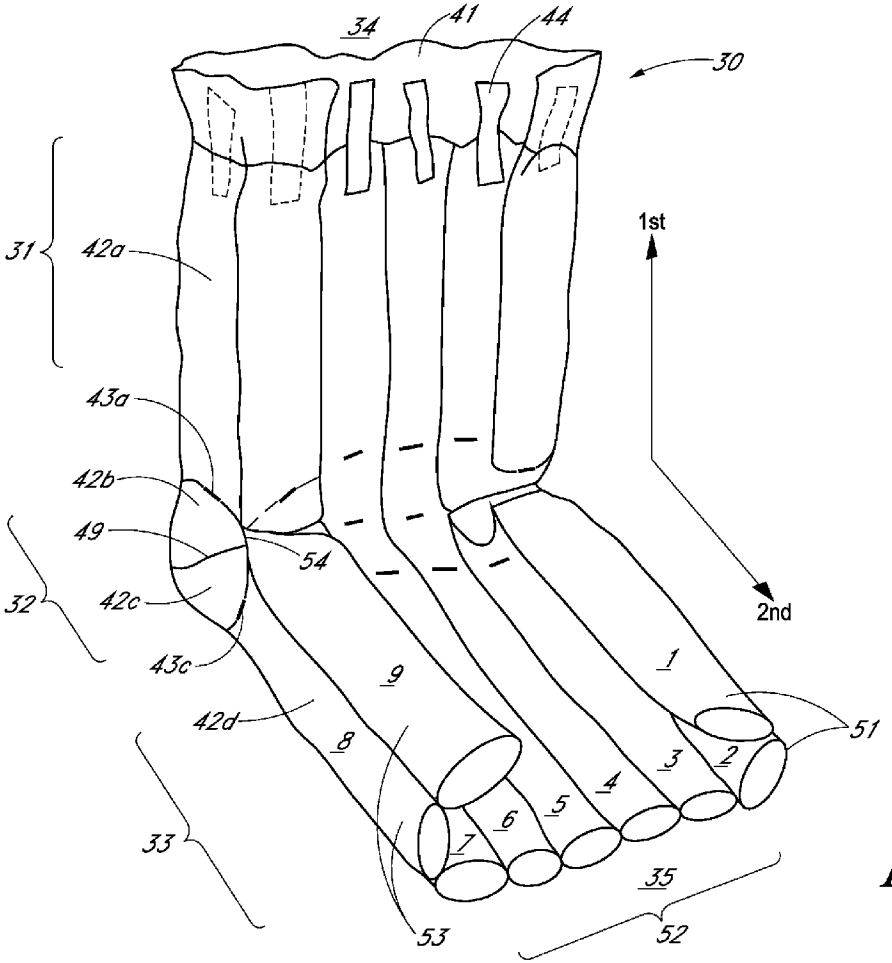
FIG. 6 is a perspective view of the final shape of the inflated corner packing device of FIG. 5, according to an embodiment of the present invention.
Figure 7:
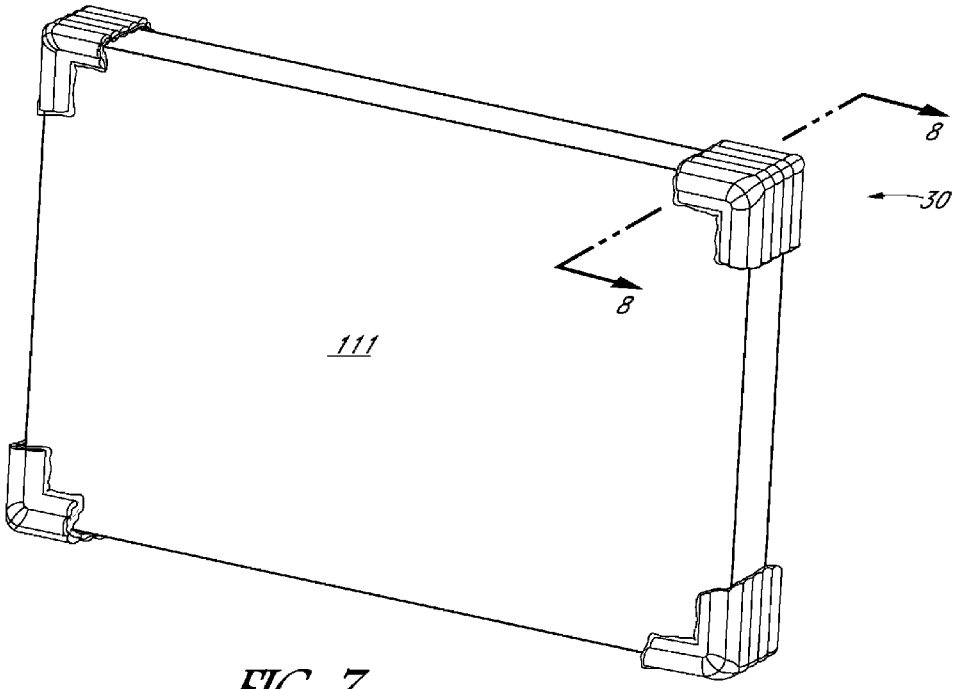
FIG. 7 is a perspective view of the inflated corner packing device of FIG. 6 in use where eight corners of a box are protected by four inflated corner packing devices, according to an embodiment of the present invention.

FIG. 6 is a schematic perspective view of the inflated corner packing device 30 shown in FIG. 7 according to an embodiment of the present invention, wherein margin portions of films constituting the device are omitted for simplification. The corner packing device 30 comprises: (i) first and second thermoplastic films (which will be explained later in relation to FIG. 1) superposed with each other and extending between a first end 34 and a second end 35 and having a first section 31 close to the first end 34, a second section 33 close to the second end 35, and an elbow section 32 connecting the first section 31 and the second section 33, wherein the first section 31 extends from the elbow section 32 along a first direction (an arrow marked with "$1^{st}$"), and the second section 33 extends from the elbow section 32 along a second direction (an arrow marked with "$2^{nd}$") roughly perpendicular (e.g., about 30° to about 150°, about 45° to about 135°, about 80° to about 100°, or about 90°, depending on the angle of a corner of a product to be protected) to the first direction, wherein predetermined portions of the first and second thermoplastic films in the first section 31, the elbow section 32, and the second section 33 are bonded creating a plurality of fluid containers 1 to 9 each extending between the first end 34 and the second end 35; (ii) a plurality of check valves 44 connected to the plurality of fluid containers 1 to 9, respectively; and (iii) a fluid passage 41 extending perpendicular to the first or second direction and connected to the check valves 44, wherein (iv) the first section 31 and the second section 33 each have a right side portion 51, a left side portion 53, and a middle portion 52 connecting the right side portion 51 and the left side portion 53, wherein the side portions 51, 52 are inwardly crooked for holding a product therebetween; wherein the first and second thermoplastic films are folded (as explained below in relation to FIG. 2), (v) the folded portion constitutes the elbow section 32, and the folded films are bonded in the elbow section 32 along a border 45 (FIG. 2) between adjacent fluid containers 1 and 2 in the crooked side portion 51 and along a border 45 (FIG. 2) between adjacent fluid containers 8 and 9 in the crooked side portion 53, leaving a remaining portion of the border unbonded, and (vi) at least the fluid containers 1, 2, 8, 9 of the crooked side portions 51, 52 are inflated, wherein the bonded borders 46*a*, 46*b* (FIG. 2) are positioned to form right and left side portions 51, 53 of the elbow section 32, respectively, wherein each right and left side portions 51, 53 each have an inner side 36*a*, 36*b* (FIG. 8) facing a product 111 to be held and an outer side 37*a*, 37*b* (FIG. 8) opposite to the inner side 36*a*, 36*b*, and the bonded borders 46*a*, 46*b* are disposed in the right and left side portions 51, 53 of the elbow section 32 on their inner sides 36*a*, 36*b*.

In FIG. 6, the bonded borders 46*a*, 46*b* are not shown since the bonded borders 46*a*, 46*b* do not appear on an outer surface of the packing device but are embedded inside the right and left side portions 51, 53 of the elbow section 32 on their inner sides 36*a*, 36*b* as explained below in relation to FIGS. 2-5.

Figure 8:
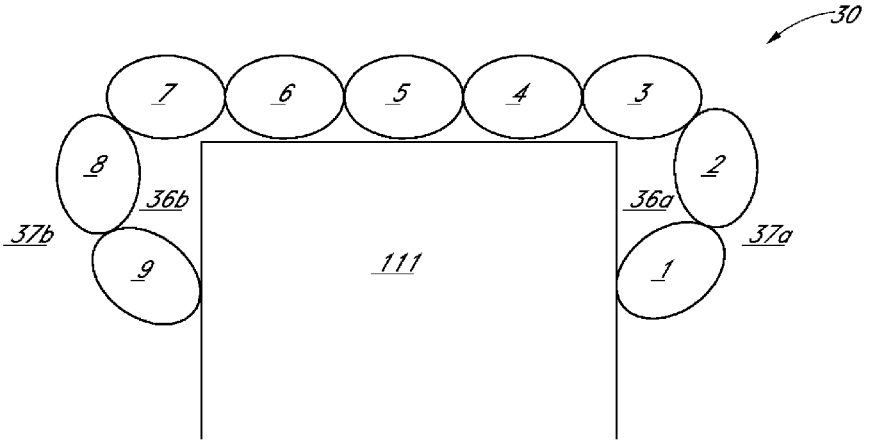
FIG. 8 is a cross sectional partial view of the inflated corner packing device placed at the upper right corners of the box in FIG. 7, taken along line 8-8, according to an embodiment of the present invention.

The number and size of the fluid containers can be adjusted according to the size of a corner of a product to be protected. FIG. 8 is a cross sectional partial view of the inflated corner packing device 30 placed at the upper right corners of the box 111 in FIG. 7, taken along line 8-8, according to an embodiment of the present invention. In this drawing, the fluid containers 3 to 7 constitute the middle portion 52, the fluid containers 1-2 constitute the right side portion 51, and the fluid containers 8-9 constitute the left side portion 53. In this embodiment, the length from the border between the fluid container 2 and the fluid container 3 to the border between the fluid container 8 and the fluid container 9 is longer than the depth of the product 111, and the length from the border between the fluid container 3 and the fluid container 4 to the border between the fluid container 7 and the fluid container 8 is shorter than the depth of the product 111, so that the packing device 30 can effectively be fitted at the corner of the product 111. In this embodiment, although all of the fluid containers 3 to 7 are inflated so that the top face of the product at the corner can be protected from shock or impact, the fluid containers 3 to 7 need not be inflated if the top face need not be protected, in which case the fluid containers 3 to 7 function as a connector connecting the right side portion 51 and the left side portion 53 so as to insert and hold the product 111 between the right side portion 51 and the left side portion 53. In some embodiments, at least one of the fluid containers 3 to 7 is inflated, e.g., the fluid containers 3, 4, 6, and 7 are inflated, and only the fluid container 5 (which is disposed in the middle) is not inflated. In some embodiments, the middle portion comprises at least one fluid container (e.g., 1 to 19 or 3 to 9). A skilled artisan in the art can readily determine an appropriate number of fluid containers and an appropriate size (the width and length) of each fluid container, depending on the depth of a product to be protected, through routine experimentation.

The fluid containers 1, 2 constituting the right side portion 51 are inflated, and the fluid containers 8, 9 constituting the left side portion 53 are inflated, so as to insert and hold the product 111 between the right side portion 51 and the left side portion 53, and to protect the front face and back face of the product 111 at the corner. The bonded borders 46*a*, 46*b* (FIG. 2) are disposed along the border 45 between the fluid container 1 and the fluid container 2 and along the border 45 between the fluid container 8 and the fluid container 9 so that the right and left side portions 51, 53 are inwardly crooked for holding the product 111 therebetween. Each side portion typically consists of two fluid containers, but in some embodiments, one or more fluid containers can be added next to the fluid containers 1, 9 so that the packing device 30 can more securely be fitted at the corner of the product 111.

In this embodiment, the middle portion 52 of each first and second sections 31, 33 has a substantially flat rectangular shape when inflated. In some embodiments, the middle portion of each first and second sections has an arched rectangular or square shape when inflated. Typically, each fluid container has the same width and length, but in some embodiments, the fluid containers of the side portions may have a different width from that of those of the middle portion.

In this embodiment, the packing device 30 further comprises a plurality of heat-seal lands 43*a*, 43*c*, 43*d* (FIGS. 1 to 6), each bonding the first and second thermoplastic films in an area of each fluid container to create a plurality of series-connected cells 42*a*, 42*b*, 42*c*, 42*d* (FIGS. 1 to 6) in each fluid container, wherein the heat-seal lands are positioned in each fluid container in a manner to allow a fluid (e.g., air, inert gas, other inactive gas, any other suitable fluid) to flow between the cells, so that the cells 42*a* constitute the first section 31, the cells 42*b*, 42*c* constitute the elbow section 32, and the cells 42*d* constitute the second section 33. Since the fluid container can easily be bent at the heat-seal land, by properly arranging the heat-seal lands, the angle of the elbow section can be adjusted. Typically, two cells per fluid container constitute the elbow section, but in some embodiments, three or more cells per fluid container constitute the elbow section.

The elbow section 32 is formed using the bonded border which will be explained below. Since the bonded border bonds the cell 42*b* of the fluid container 1 and the cell 42*b* of the fluid container 2, and also the cell 42*c* of the fluid container 1 and the cell 42*c* of the fluid container 2, when the cells 42*b* and 42*c* of each right and left side portions 51, 53 are inflated, the cells 42*b*, 42*c* of each of the fluid containers 1, 2, 8, and 9 are compressed against each other and deformed, forming triangle-shaped cells each having an edge of the bonded border as an apex 54 (FIGS. 2 and 4-6), thereby forming the elbow section 32. In some embodiments, the elbow section is formed as explained below.

FIG. 1 is a plan view of an initial sheet 30*a* of an inflatable corner packing device according to an embodiment of the present invention. In this embodiment, the initial sheet 30*a* is comprised of first and second thermoplastic films superposed with each other and extending between a first end 34 and a second end 35 and having a first section 31 close to the first end 34, a second section 33 close to the second end 35, and an elbow section 32 connecting the first section 31 and the second section 33, wherein the first section 31 extends from the elbow section 32 toward the first end 34, and the second section 33 extends from the elbow section 32 toward the second end 35, wherein predetermined portions of the first and second thermoplastic films in the first, elbow, and second sections 31, 32, 33 are bonded creating a plurality of fluid containers 1 to 9 each extending between the first and second ends 34, 35; a plurality of check valves 44 are connected to the plurality of fluid containers 1 to 9, respectively; a fluid passage 41 extends perpendicular to the length direction and connected to the check valves 44; and the first and second sections 31, 33 each have a right side portion 51, a left side portion 53, and a middle portion 52 connecting the right and left side portions 51, 53 (since the sheet is flexed inside out when being inflated, the right and left are reversed in this drawing). The sheet 30*a* has margins 47, 48 outside the fluid containers. However, the margins are incidental and thus omitted from the other drawings. The fluid passage 41 extends between the side portions 51, 53, and has a stopper 71 at an end where air is supplied In this embodiment, the stopper 71 is formed by bonding a portion of the first and second thermoplastic films in the fluid passage.

In this embodiment, each fluid container comprises a plurality of heat-seal lands 43*a*, 43*b*, 43*c* each bonding the first and second thermoplastic films in an area of each fluid container to create a plurality of series-connected cells 42*a*, 42*b*, 42*c*, 42*d* in each fluid container, wherein the heat-seal lands 43*a*, 43, 43*c* are positioned in each fluid container in a manner to allow a fluid to flow between the cells. In this embodiment, the heat-seal lands 43*a* are aligned along a first border between the first section 31 and the elbow section 32, the heat-seal lands 43*c* are aligned along a second border between the second section 33 and the elbow section 32, and the heat-seal lands 43*b* are aligned along a central edge between the first and second borders. In this embodiment, a width (W) of each fluid container is substantially the same as or slightly smaller than a length (L) between the first border and the central edge, and a length (L) between the second border and the central edge when inflated.

Figure 2:
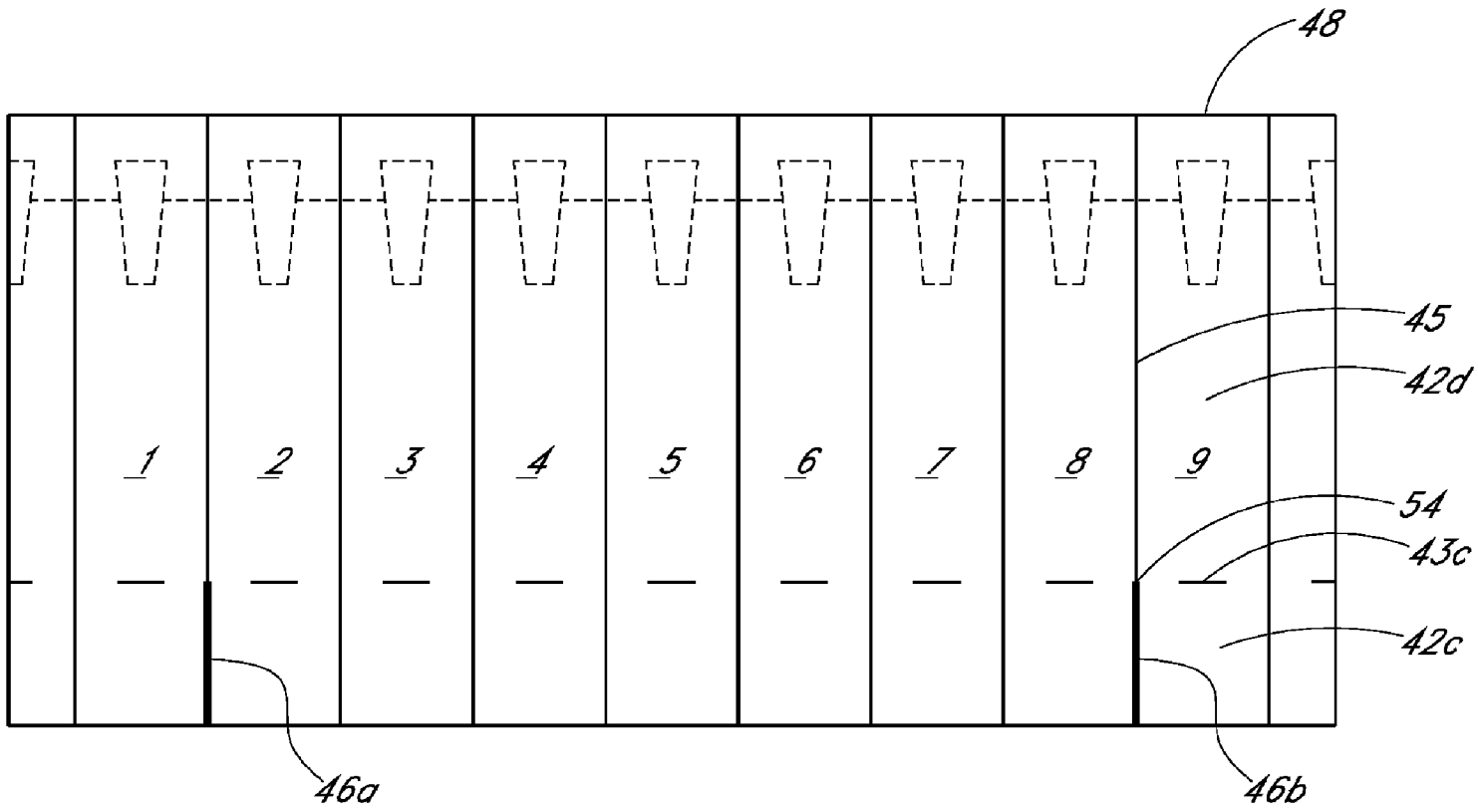
FIG. 2 is a plan view of the inflatable corner packing device, which is not inflated, obtained from the initial sheet of FIG. 1 where the sheet is folded into two and partially bonded, according to an embodiment of the present invention.

FIG. 2 is a plan view of the inflatable corner packing device, which is not inflated, obtained from the initial sheet of FIG. 1 where the sheet is folded into two and partially bonded, according to an embodiment of the present invention. In this embodiment, the first and second thermoplastic films are folded, wherein the folded portion constitutes the elbow section 32, and the folded films are bonded in the elbow section along borders 46*a*, 46*b* between adjacent fluid containers (1 and 2, 8 and 9) in the respective side portions 51, 53, leaving remaining portions of the borders 45 unbonded, wherein the bonded borders 46*a*, 46*b* are positioned to form right and left side portions 51, 53 of the elbow section 32, respectively.

Figure 3:
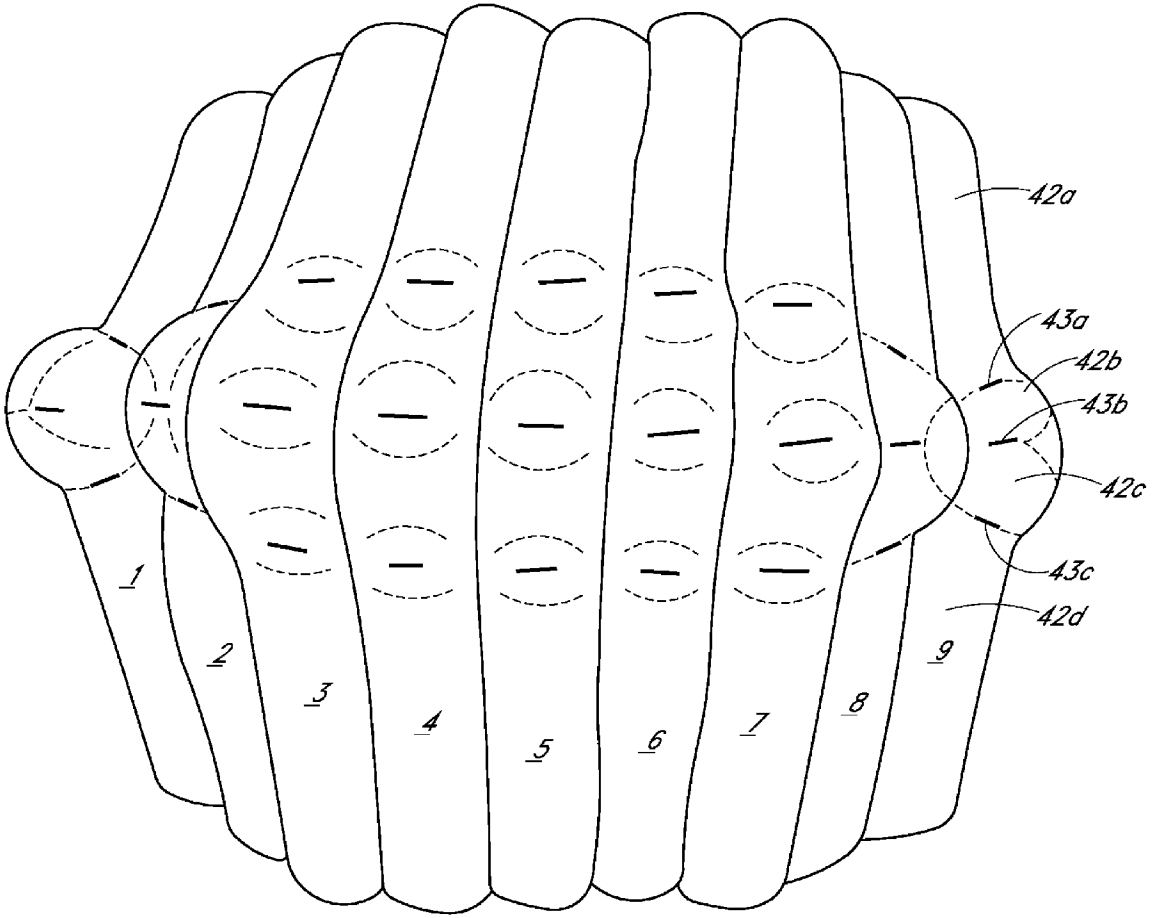
FIG. 3 is a front view of an intermediate convex shape of the inflatable corner packing device which is obtained by inflating the inflatable corner packing device of FIG. 2 where the inflated corner packing device is slightly arched (convex viewed from the front) due to the partially bonded areas, according to an embodiment of the present invention.

FIG. 3 is a front view of an intermediate convex shape of the inflatable corner packing device which is obtained by inflating the inflatable corner packing device of FIG. 2 where the inflated corner packing device is slightly arched (convex viewed from the front) due to the partially bonded areas, according to an embodiment of the present invention. In this embodiment, since each bonded border 46*a*, 46*b* bonds the cell 42*b* of the fluid container 1 and the cell 42*b* of the fluid container 2, and also the cell 42*c* of the fluid container 1 and the cell 42*c* of the fluid container 2, when the cells 42*b* and 42*c* of each right and left side portions 51, 53 are inflated, the cells 42*b*, 42*c* of each of the fluid containers 1, 2, 8, and 9 are compressed against each other and deformed, forming a convex shape as shown in FIG. 3.

Figure 4:
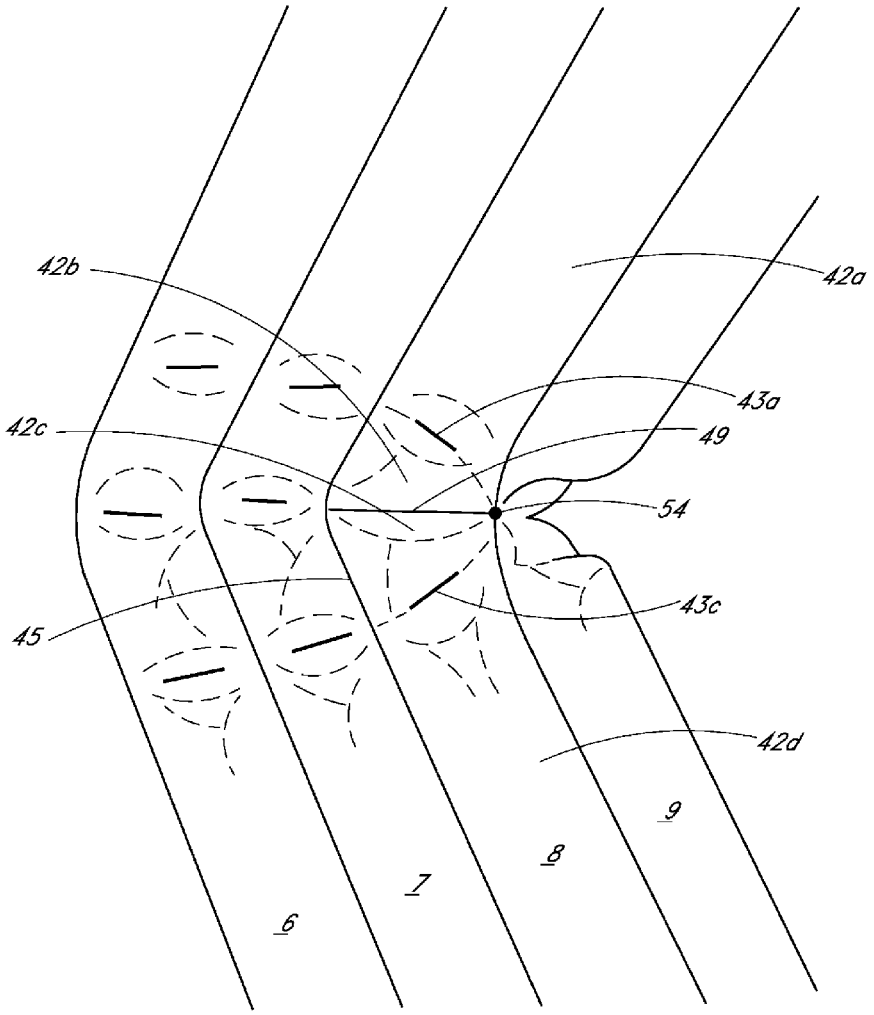
FIG. 4 is a perspective enlarged partial view of the inflated corner packing device of FIG. 3 viewed from the back toward the left side, according to an embodiment of the present invention.

FIG. 4 is a perspective enlarged partial view of the inflated corner packing device of FIG. 3 viewed from the back toward the left side, according to an embodiment of the present invention. As a result of the cells 42*b*, 42*c* of each of the fluid containers 1, 2, 8, and 9 being compressed against each other and deformed, triangle-shaped cells each having an edge 54 of the bonded border 46*a*, 46*b* (FIG. 2) as an apex are formed. In FIG. 4, the cell 42*b* and the cell 42*c* of the fluid container 8 are contacted and compressed to each other, forming a deformation border 49, wherein the cell 42*b* is deformed such that the deformation border 49, a line including the heat-seal land 43*a*, and a line defined by the border 45 form a triangle having the edge 54 of the bonded border 46*b* as an apex, and also, the cell 42*c* is deformed such that the deformation border 49, a line including the heat-seal land 43*c*, and a line defined by the border 45 form a triangle having the edge 54 of the bonded border 46*b* as an apex. Deformation similar to the above occurs in the cells 42*b*, 42*c* of the fluid container 1, 2, and 9.

Figure 5:
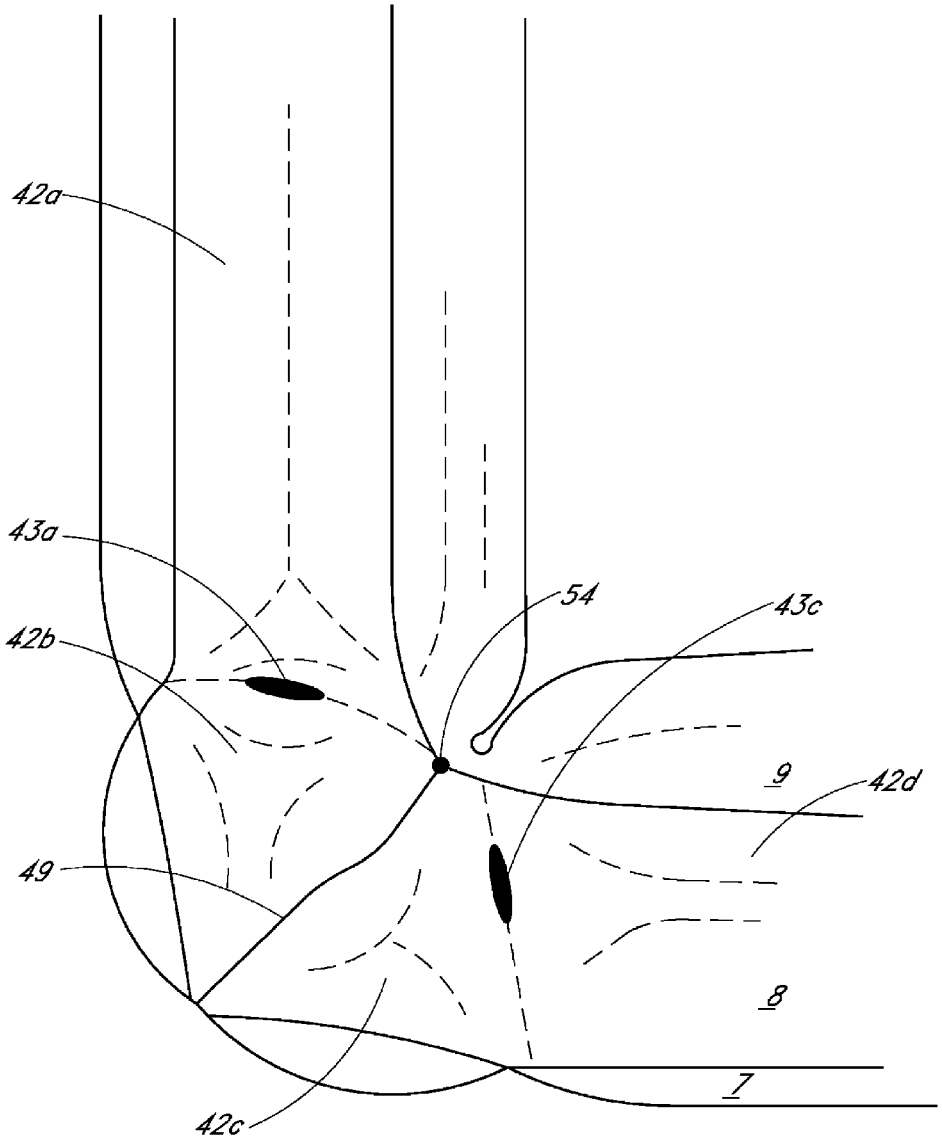
FIG. 5 is a left side enlarged partial view of a final shape of the inflated corner packing device of FIG. 4 which has been flexed inside out wherein a portion adjacent to the bonded area constitutes a corner, according to an embodiment of the present invention.

FIG. 5 is a left side enlarged partial view of a final shape of the inflated corner packing device of FIG. 4 which has been flexed inside out (flipping) wherein a portion adjacent to the bonded area constitutes a corner, according to an embodiment of the present invention. As a result of flexing, the convex shape of the inflated packing device is changed to a concave shape, and in this embodiment, the cells 42*b*, 42*c* of the fluid container 8 having the triangle shapes sharing the deformation border 49 as one side of each triangle in FIG. 4 are converted to form the corner of the elbow section 32 on an outer side 37*b* which is opposite to an inner side 36*b* facing a product to be held (FIG. 8). As understood from FIG. 5, the angle between the first section 31 and the second section 33 can be adjusted by adjusting the width (W) and the length (L) of the cells 42*b*, 42*c* (FIG. 1). As a basic approach, when the width (W) of each fluid container in the side portion is substantially the same as the length (L) between the first border and the central edge, and the length (L) between the second border and the central edge when inflated, the elbow angle between the first section 31 and the second section 33 can be approximately 90°, i.e., each triangle is approximately an isosceles right triangle. However, since the cells are inflated and pushed against each other at the elbow section 32, when W is substantially the same as L, the elbow angle between the first section 31 and the second section 33 is likely to be more than 90°, and thus, preferably W is slightly smaller than L for an elbow angle of approximately 90°. In some embodiments, a ratio of W/L is 4/10 to 15/10 or 6/10 to 12/10 (preferably, 6/10 to 9/10). The elbow angle can be adjusted without using the heat-seal lands and cells, by adjusting the length of the bonded borders relative to the width of the fluid container based on the same principle as above. The bonded borders 46*a*, 46*b* are disposed in the right and left side portions 51, 53 of the elbow section 32 on their inner sides, and do not appear on an outer surface of the packing device.

Figure 9:
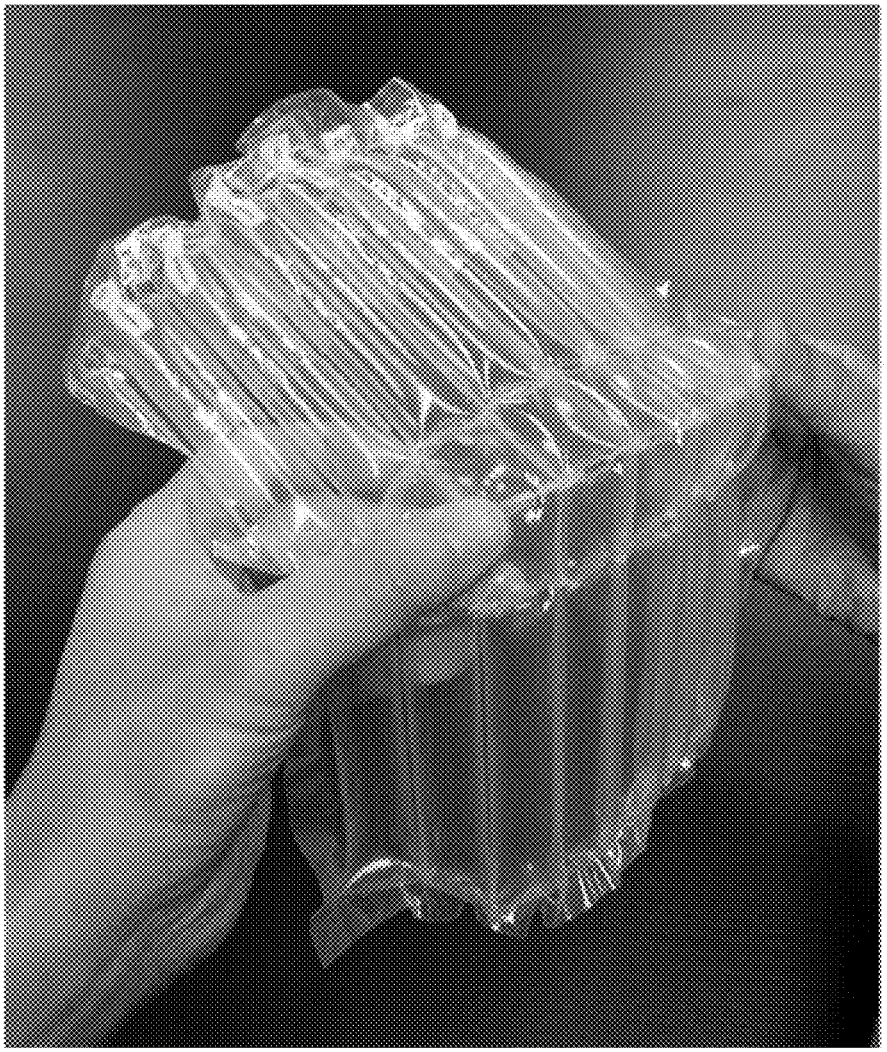
FIG. 9 is a photograph showing the intermediate convex shape of the inflated corner packing device of FIG. 3, according to an embodiment of the present invention.
Figure 10:
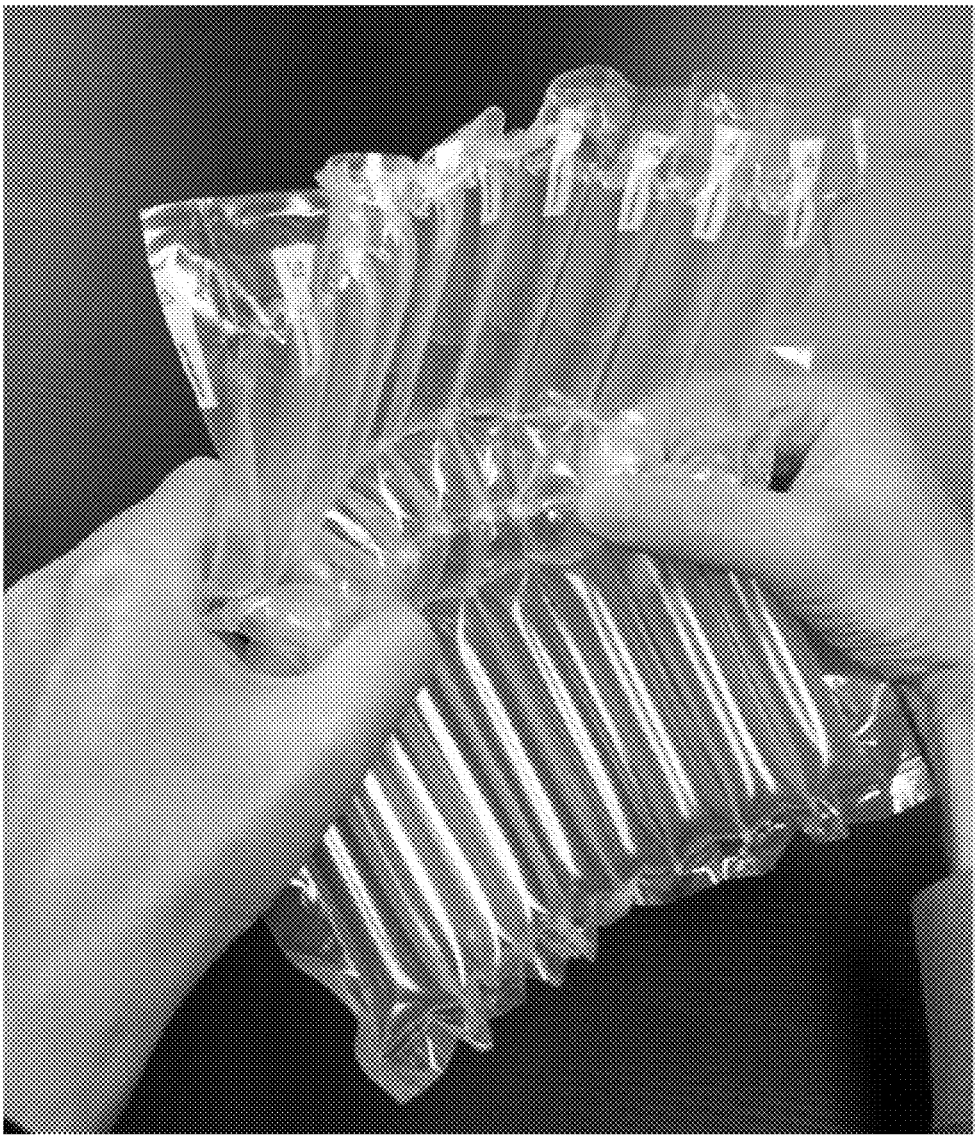
FIG. 10 is a photograph showing an intermediate concave shape of the inflated corner packing device, obtained by flexing points where the bonded borders are located of the intermediate convex shape of the inflated corner packing device of FIG. 9, according to an embodiment of the present invention.
Figure 11:
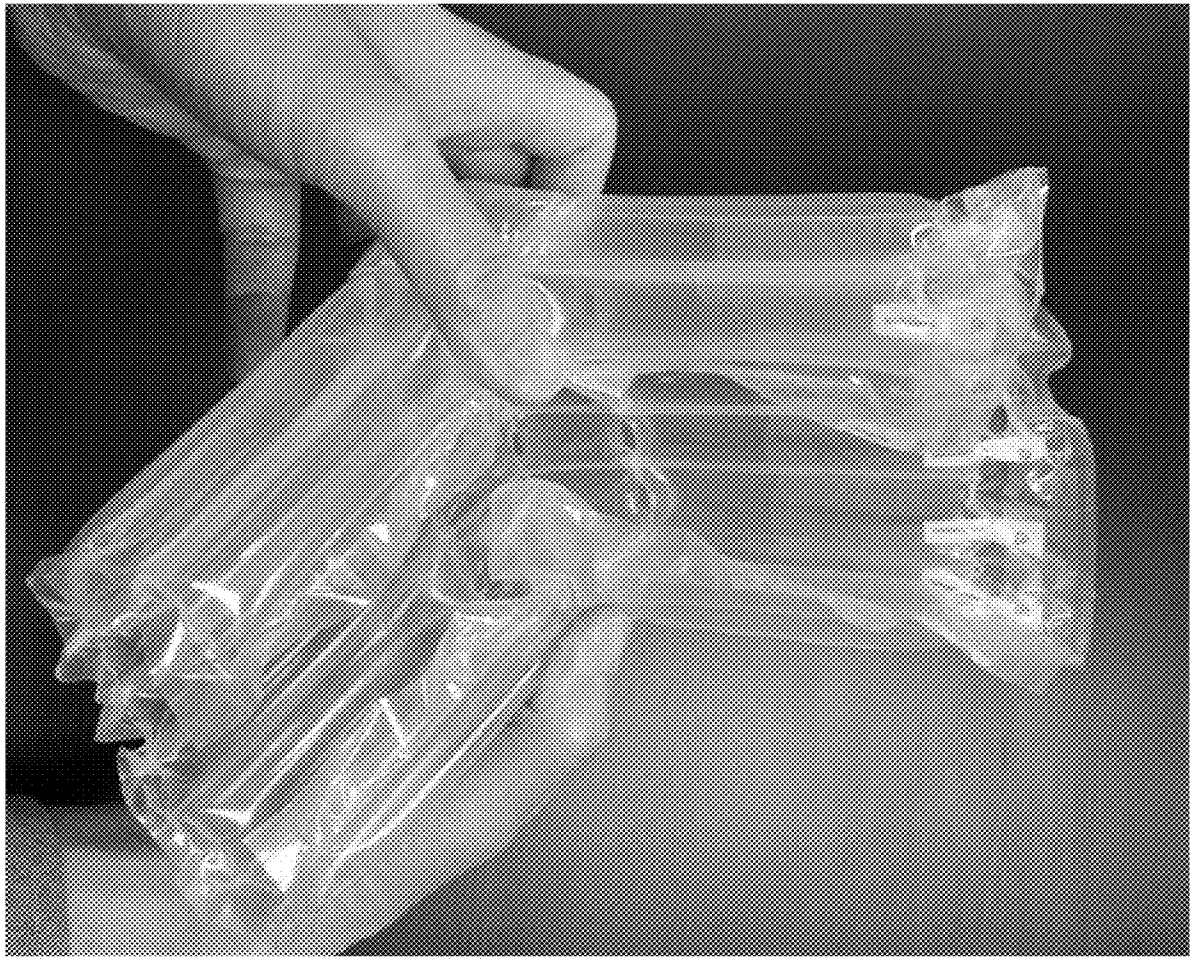
FIG. 11 is a photograph showing the final shape of the inflated corner packing device of FIG. 6, obtained by making left and right corners using portions adjacent to the partially bonded areas, according to an embodiment of the present invention.

The flexing of the inflated packing device of an intermediate convex shape to those of a final concave shape can be conducted by hands or a machine or any other suitable means. FIG. 9 is a photograph showing the intermediate convex shape of the inflated corner packing device of FIG. 3, according to an embodiment of the present invention. FIG. 10 is a photograph showing an intermediate concave shape of the inflated corner packing device, obtained by flexing points where the bonded borders are located of the intermediate convex shape of the inflated corner packing device of FIG. 9, according to an embodiment of the present invention. FIG. 11 is a photograph showing the final shape of the inflated corner packing device of FIG. 6, obtained by making left and right corners using portions adjacent to the partially bonded areas, according to an embodiment of the present invention. Thus, in order to complete transformation of the shapes of the inflated packing device, the intermediate concave shape shown in FIG. 10 obtained by flexing the intermediate convex shape needs to be further transformed to the final concave shape by pushing the deformed cells on the right and left sides outwards to form corners of the elbow section. This can easily be accomplished since the heal-seal lands are provided where bending is required.

Figure 12:
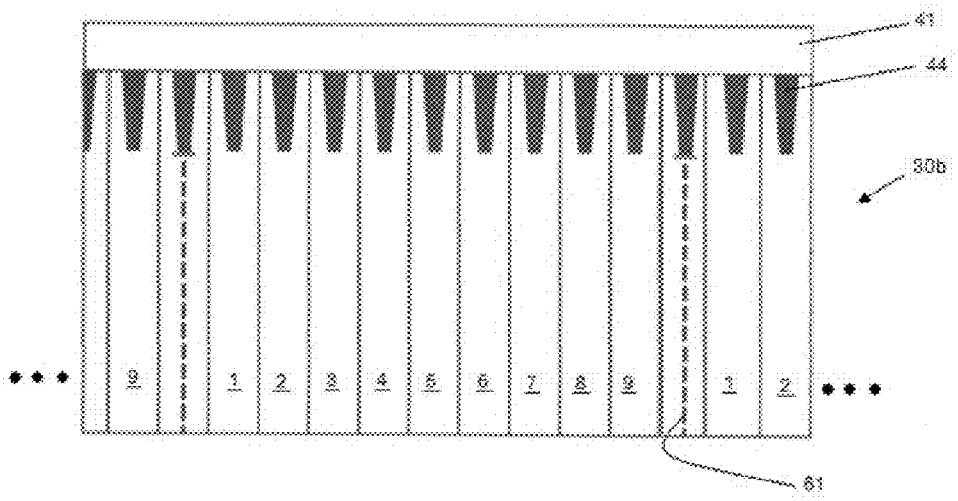
FIG. 12 is a plan view of an initial sheet of an inflatable corner packing device with perforations, according to an embodiment of the present invention.
Figure 13:
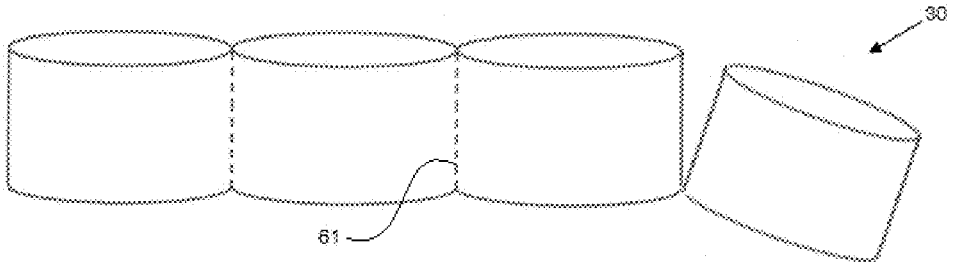
FIG. 13 is an overly schematic view of a inflated sheet of FIG. 12, wherein an inflated corner packing device is separated along the perforation, according to an embodiment of the present invention.
Figure 14:
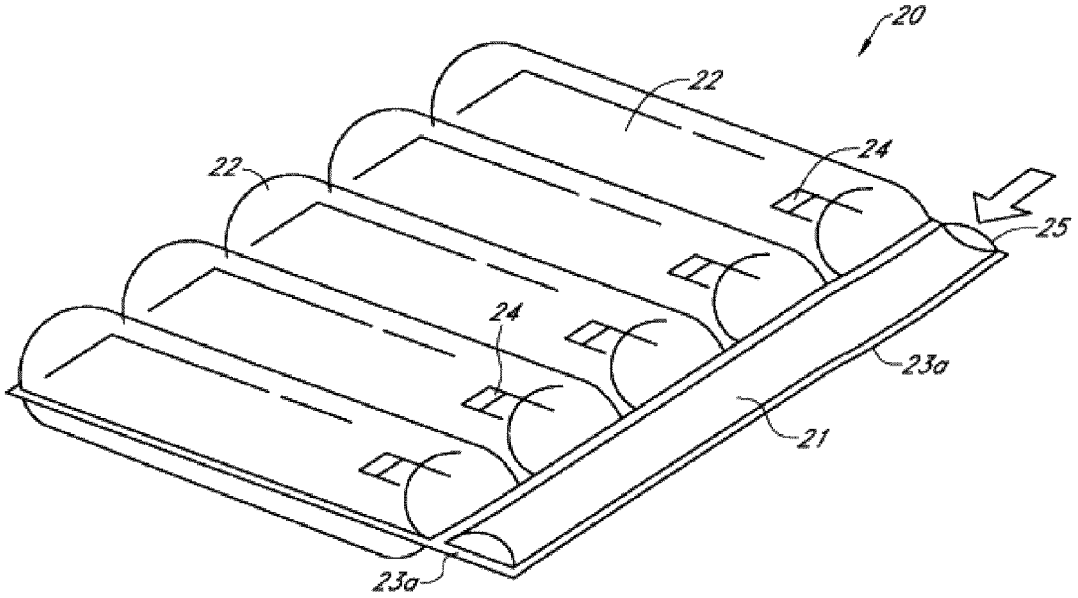
FIG. 14 Background Art
FIG. 14 is a schematic perspective view showing an example of basic structure of conventional air-packing device.
Figure 15:
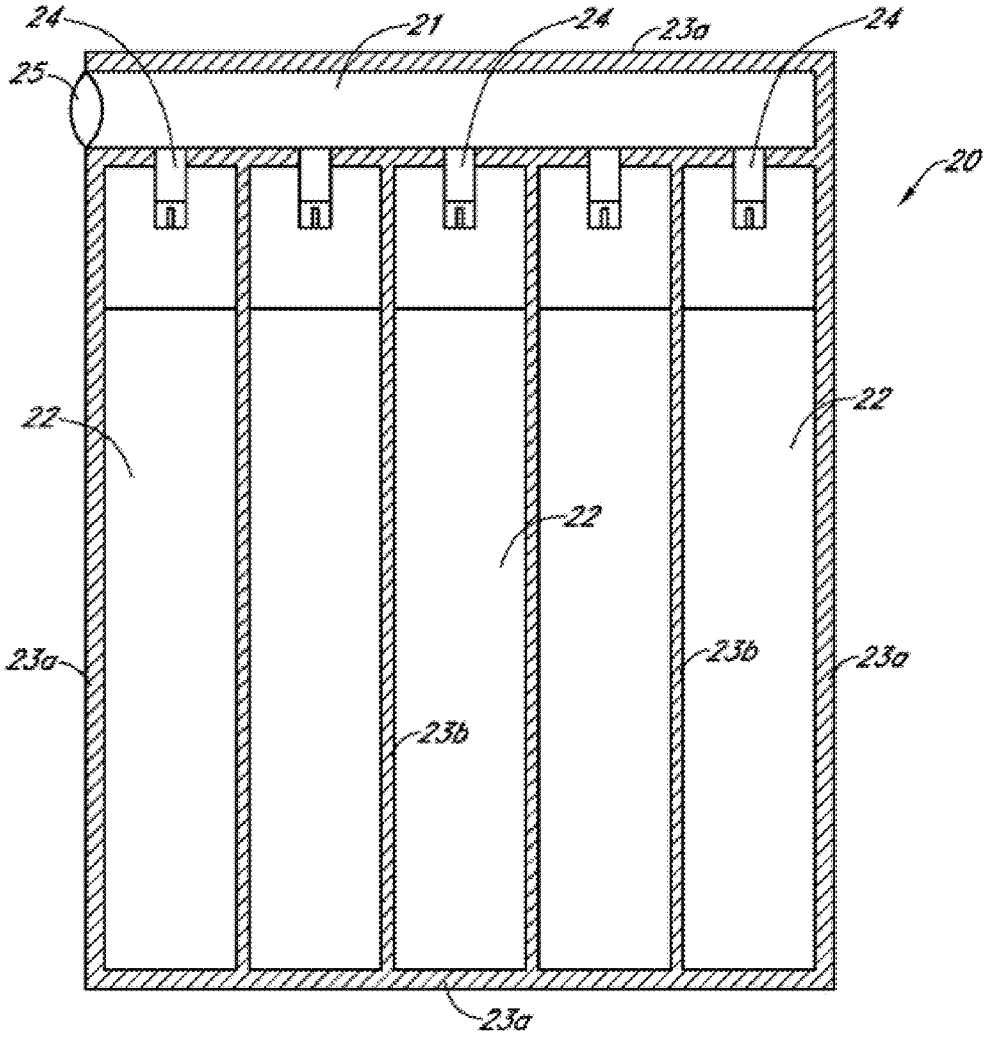
FIG. 15 Background Art
FIG. 15 is a plan view of the air-packing device 20 of FIG. 14 when it is not inflated for showing bonding areas for closing two thermoplastic films.

In some embodiments, as compared with the sheet shown in FIG. 1, packing devices can be produced more efficiently by using a zonal sheet comprising multiple sheets each as defined above, wherein the multiple sheets are connected in a direction perpendicular to the first direction, wherein borders between adjacent sheets are perforated so that the multiple sheets are separable along the borders. FIG. 12 is a plan view of an initial sheet of an inflatable corner packing device with perforations, according to an embodiment of the present invention, wherein a zonal sheet 30*b* comprises multiple sheets each as defined in FIG. 1, wherein the multiple sheets are connected in a direction perpendicular to the first direction, wherein borders 61 between adjacent sheets are perforated so that the multiple sheets are separable along the borders 61. FIG. 13 is an overly schematic view of a inflated sheet of FIG. 12, wherein an inflated corner packing device is separated along the perforation border 61, according to an embodiment of the present invention. Although separation of each sheet is conducted typically after inflating the sheet, alternatively, separation of each sheet can be conducted before inflating the sheet. By using a zonal sheet, the productivity can be increased, and it is possible to accommodate various sizes of products to be protected by selecting the perforation locations where perforation borders are provided every minimum number of fluid containers (such as 1, 2, 3, etc.).

It will be understood by those of skill in the art that numerous and various modifications can be made without departing from the spirit of the present invention. Therefore, it should be clearly understood that the forms of the present invention are illustrative only and are not intended to limit the scope of the present invention.

I claim:

1. An inflatable corner packing device comprising:

first and second thermoplastic films superposed with each other and extending between a first end and a second end and having a first section close to the first end, a second section close to the second end, and an elbow section connecting the first section and the second section, said first section extending from the elbow section along a first direction, said second section extending from the elbow section along a second direction roughly perpendicular to the first direction, wherein:

predetermined portions of the first and second thermoplastic films in the elbow section, and second sections are bonded creating a plurality of fluid containers each extending between the first and second ends;

the first and second sections and the elbow section each have a right side portion, a left side portion, and a middle portion connecting the right and left side portions along a lateral direction perpendicular to the first and second directions, said side portions being inwardly crooked for holding a product therebetween;

the first and second thermoplastic films are folded wherein the folded portion constitutes the elbow section, and the folded films are bonded in the elbow section along a border between adjacent fluid containers in each of the right and left side portions, leaving a remaining portion of the border unbonded; and at least the fluid containers of the right and left side portions are inflated, wherein bonded borders are positioned to form the right and left side portions of the elbow section, respectively, wherein the right and left side portions each have an inner side facing a product to be held and an outer side opposite to the inner side, and the bonded borders are disposed in the right and left side portions of the elbow section on their inner sides;

said inflatable corner packing device further comprising: a plurality of check valves connected to the plurality of fluid containers, respectively; and a fluid passage extending perpendicular to the first and second directions and connected to the check valves.

2. The inflatable corner packing device of claim 1, wherein the bonded borders are disposed in the right and left side portions of the elbow section on their inner sides by reversing a convex shape formed by the first section, the elbow section, and the second section when the fluid containers are inflated due to the bonded borders, to a concave shape by pushing the bonded borders forward and outward to form the respective corners of the elbow section.

3. The inflatable corner packing device of claim 1, further comprising a plurality of heat-seal lands each bonding the first and second thermoplastic films in an area of each fluid container to create a plurality of series-connected cells in each fluid container, wherein the heat-seal lands are positioned in each fluid container in a manner to allow a fluid to flow between the cells.

4. The inflatable corner packing device of claim 3, wherein the heat-seal lands are aligned along a first border between the first section and the elbow section, a second border between the second section and the elbow section, and a central edge between the first and second borders.

5. The inflatable corner packing device of claim 4, wherein a width of each fluid container in each crooked side portion is substantially the same as or slightly smaller than a length between the first border and the central edge, and a length between the second border and the central edge when inflated.

6. The inflatable corner packing device of claim 3, wherein the elbow section consists of two cells per fluid container.

7. The inflatable corner packing device of claim 1, wherein the plurality of fluid containers extend in the first and second directions.

8. The inflatable corner packing device of claim 1, wherein the middle portion comprises at least one of the plurality of fluid containers.

9. The inflatable corner packing device of claim 1, wherein each fluid container contains a gas or fluid.

10. The inflatable corner packing device of claim 1, wherein the fluid passage extends between the crooked side portions, and has a stopper at the second end.

11. The inflatable corner packing device of claim 10, wherein the stopper is formed by bonding a portion of the first and second thermoplastic films in the fluid passage.

12. The inflatable corner packing device of claim 1, wherein the middle portion of each first and second sections has a substantially flat rectangular shape when inflated.

* * * * *